US011120642B2

(12) United States Patent
Rapeta et al.

(10) Patent No.: US 11,120,642 B2
(45) Date of Patent: Sep. 14, 2021

(54) FUNCTIONAL SAFETY CRITICAL AUDIO SYSTEM FOR AUTONOMOUS AND INDUSTRIAL APPLICATIONS

(71) Applicant: Intel Corporation, Santa Clara, CA (US)

(72) Inventors: Jagannadha Rao Rapeta, Folsom, CA (US); Asad Azam, Folsom, CA (US); Amit Kumar Srivastava, Folsom, CA (US)

(73) Assignee: INTEL CORPORATION, Santa Clara, CA (US)

( * ) Notice: Subject to any disclaimer, the term of this patent is extended or adjusted under 35 U.S.C. 154(b) by 493 days.

(21) Appl. No.: 16/019,945

(22) Filed: Jun. 27, 2018

(65) Prior Publication Data

US 2019/0051060 A1 Feb. 14, 2019

(51) Int. Cl.

| | |
|---|---|
| ***G07C 5/00*** | (2006.01) |
| ***H04R 1/32*** | (2006.01) |
| ***H04R 29/00*** | (2006.01) |
| ***G08B 29/12*** | (2006.01) |
| ***G07C 5/08*** | (2006.01) |

(52) U.S. Cl.

CPC ..... *G07C 5/006* (2013.01); *G08B 29/126* (2013.01); *H04R 1/326* (2013.01); *H04R 29/00* (2013.01); *H04R 29/001* (2013.01); *G07C 5/0833* (2013.01); *H04R 2217/03* (2013.01); *H04R 2499/13* (2013.01)

(58) Field of Classification Search

CPC ..... G07C 5/006; G07C 5/008; G07C 5/085; G07C 5/0833; G08B 29/126; H04R 1/326; H04R 29/001; H04R 29/00; H04R 1/1016; H04R 3/12; H04R 2499/11; H04R 2217/03; H04R 29/01; H04R 3/00; H04L 67/12; H04L 1/0002; H04L 1/0041; H04L 1/18

See application file for complete search history.

(56) References Cited

U.S. PATENT DOCUMENTS 4,038,634 A * 7/1977 Caliri ..... G07C 5/00 340/459
4,099,234 A 7/1978 Woods et al.
5,682,134 A * 10/1997 Stallbohm ..... B60R 25/1009 340/426.27

(Continued)

OTHER PUBLICATIONS

Non-Final office action dated May 28, 2020, to U.S. Appl. No. 15/942,466.

(Continued)

*Primary Examiner* — Luis A Martinez Borrero

(74) *Attorney, Agent, or Firm* — Spectrum IP Law Group LLC

(57) ABSTRACT

Methods and apparatus relating to functional safety critical audio system for autonomous and industrial applications are described. In an embodiment, safety island logic circuitry transmits an enable signal to cause initiation of a functional safety test for an audio component in a vehicle. Audio processing logic circuitry receives the enable signal and causes activation of power amplifier logic circuitry, in response to the enable signal, to drive the audio component in accordance with an audio alert test signal. The audio component includes a Parametric Acoustic Array (PAA) transducer. Other embodiments are also disclosed and claimed.

19 Claims, 8 Drawing Sheets

(56) References Cited

U.S. PATENT DOCUMENTS 6,247,143 B1 6/2001 Williams
6,357,033 B1 3/2002 Jippo
7,058,190 B1 * 6/2006 Zakarauskas ..... H04R 29/00 381/122
7,106,180 B1 * 9/2006 Pompei ..... A01M 29/18 340/384.7
7,292,141 B2 * 11/2007 Staats ..... G08B 3/10 340/539.12
7,548,625 B2 * 6/2009 Dorfman ..... H04R 29/001 381/58
7,961,891 B2 * 6/2011 Dorfman ..... H04R 29/004 381/58
8,155,326 B2 * 4/2012 Schweitzer, III ... G01M 13/028 381/56
8,217,766 B2 * 7/2012 Nakayama ..... B60Q 5/006 340/384.1
8,438,306 B2 5/2013 Lescure et al.
8,930,752 B2 1/2015 Gara et al.
9,454,893 B1 * 9/2016 Warren ..... G08B 17/10
9,479,865 B2 * 10/2016 Nguyen ..... G06F 3/0433
9,517,767 B1 * 12/2016 Kentley ..... B60W 30/095
9,641,918 B2 * 5/2017 Staudenmaier ..... H04R 1/00
9,781,527 B2 * 10/2017 Zaman ..... H04R 29/00
10,448,151 B1 * 10/2019 McNair ..... H04R 1/406
10,506,338 B2 * 12/2019 Howlett ..... H03F 3/187
10,580,288 B2 * 3/2020 Layton ..... G11B 20/18
2002/0152418 A1 10/2002 Griffin et al.
2002/0152420 A1 10/2002 Chaudhry et al.
2003/0005380 A1 1/2003 Nguyen et al.
2003/0200014 A1 * 10/2003 Remboski ..... G01M 15/04 701/33.9
2005/0093622 A1 * 5/2005 Lee ..... H03F 1/523 330/10
2005/0240793 A1 10/2005 Safford et al.
2006/0188115 A1 * 8/2006 Lenhardt ..... H04R 25/353 381/312
2006/0248288 A1 11/2006 Bruckert et al.
2009/0295591 A1 * 12/2009 Bedingfield ..... A61M 1/14 340/660
2009/0325534 A1 * 12/2009 Kennelly ..... H04W 24/06 455/403
2010/0045476 A1 * 2/2010 Lenhardt ..... G08B 1/08 340/692
2010/0085195 A1 * 4/2010 Bennett ..... G08B 29/10 340/577
2011/0129101 A1 * 6/2011 Hooley ..... H04R 3/005 381/92
2011/0175713 A1 * 7/2011 Nakayama ..... B60Q 5/008 340/435
2011/0179308 A1 7/2011 Pathirane et al.
2012/0148053 A1 * 6/2012 Tan ..... H04R 1/403 381/1
2012/0210164 A1 8/2012 Gara et al.
2013/0294609 A1 * 11/2013 Tackett ..... H04R 29/007 381/56
2013/0295913 A1 * 11/2013 Matthews, III ... H04M 1/72457 455/420
2014/0269214 A1 * 9/2014 Baym ..... H04R 3/00 367/197
2014/0307881 A1 * 10/2014 Fuertes, III ..... H04R 29/001 381/59
2015/0281836 A1 * 10/2015 Nguyen ..... H03F 3/181 381/120
2016/0063997 A1 * 3/2016 Nemala ..... G10L 25/06 704/233
2016/0073211 A1 * 3/2016 Zaman ..... H04R 29/00 381/58
2016/0343241 A1 * 11/2016 Rossi ..... G08B 29/126
2016/0343242 A1 * 11/2016 Warren ..... G08B 5/36
2017/0124818 A1 * 5/2017 Ullrich ..... G06F 3/016
2017/0297568 A1 * 10/2017 Kentley ..... G09G 5/363
2017/0357390 A1 * 12/2017 Alonso Ruiz ..... G06F 3/04886
2018/0129573 A1 5/2018 Iturbe et al.
2018/0160203 A1 * 6/2018 Husnik ..... H04R 1/005
2018/0376246 A1 * 12/2018 Howlett ..... H03F 3/187
2019/0124443 A1 * 4/2019 Chang ..... H04R 3/007
2019/0124446 A1 * 4/2019 Pan ..... B60Q 5/006
2019/0163583 A1 5/2019 Fahim et al.
2019/0182415 A1 6/2019 Sivan
2019/0378401 A1 * 12/2019 Layton ..... G11B 20/18
2019/0385583 A1 * 12/2019 Muggleton ..... H04R 29/004
2019/0389602 A1 12/2019 Schilling

OTHER PUBLICATIONS

Notice of Allowance dated Nov. 10, 2020 to U.S. Appl. No. 15/942,466.

* cited by examiner

FUNCTIONAL SAFETY CRITICAL AUDIO SYSTEM FOR AUTONOMOUS AND INDUSTRIAL APPLICATIONS

FIELD

The present disclosure generally relates to the field of electronics. More particularly, an embodiment relates to functional safety critical audio system for autonomous and industrial applications.

BACKGROUND

Functional safety is important for the real time complex systems such as IOT (Internet Of Things) applications, like automotive and industrial segments. All these applications may impose tight constraints on the system to perform safely and reliably under complex and noisy system environments across a product's life cycle.

Additionally, functional safety critical automotive and industrial applications require a reliable audio safety alert warning chime system, e.g., enabled with embedded on-demand or self-checking safety mechanisms. This puts constraints on system to periodically enable safety mechanisms to monitor the fidelity of the 'Alert Audio Messaging System' wherever functional safety is of primary concern, without disturbing an end-user at the same time an audio message is delivered during a real safety alert.

However, conventional audio systems used for functional safety may use a communication channel that is omnidirectional. With such an implementation, it is not possible to periodically enable safety mechanisms to monitor the 'Alert Audio Messaging' without disturbing the end-user.

BRIEF DESCRIPTION OF THE DRAWINGS

The detailed description is provided with reference to the accompanying figures. In the figures, the left-most digit(s) of a reference number identifies the figure in which the reference number first appears. The use of the same reference numbers in different figures indicates similar or identical items.

DETAILED DESCRIPTION

In the following description, numerous specific details are set forth in order to provide a thorough understanding of various embodiments. However, various embodiments may be practiced without the specific details. In other instances, well-known methods, procedures, components, and circuits have not been described in detail so as not to obscure the particular embodiments. Further, various aspects of embodiments may be performed using various means, such as integrated semiconductor circuits ("hardware"), computer-readable instructions organized into one or more programs ("software"), or some combination of hardware and software. For the purposes of this disclosure reference to "logic" shall mean either hardware (such as logic circuitry or more generally circuitry or circuit), software, firmware, or some combination thereof.

As mentioned above, conventional audio systems used for functional safety may use a communication channel that is omnidirectional (e.g., sensing audio signals using a microphone). With such an implementation, it is not possible to periodically enable safety mechanisms to monitor the 'Alert Audio Messaging' without disturbing an end-user. Hence, the end-user will be hearing (and being distracted) by the periodic alert audio messages.

To this end, some embodiments relate to functional safety critical audio system for autonomous and industrial applications (which operate without distracting an end-user). In an embodiment, a Parametric Acoustic Array (PAA) is used for audio communication. One or more PAAs may be used in part because they provide high directivity and may be used for continuous monitoring of an audio system for functional safety (e.g., using a voice loop back), without disturbing the end-user. In one embodiment, safety island logic generates audio test patterns which are used to provide functional safety. In another embodiment, an audio loopback communication mismatch detection mechanism is provided where audio processing unit(s) would be able to provide corrective feedback using an audio channel (e.g., from a host unit to CODEC (Coder-Decoder) logic).

Figure 1:
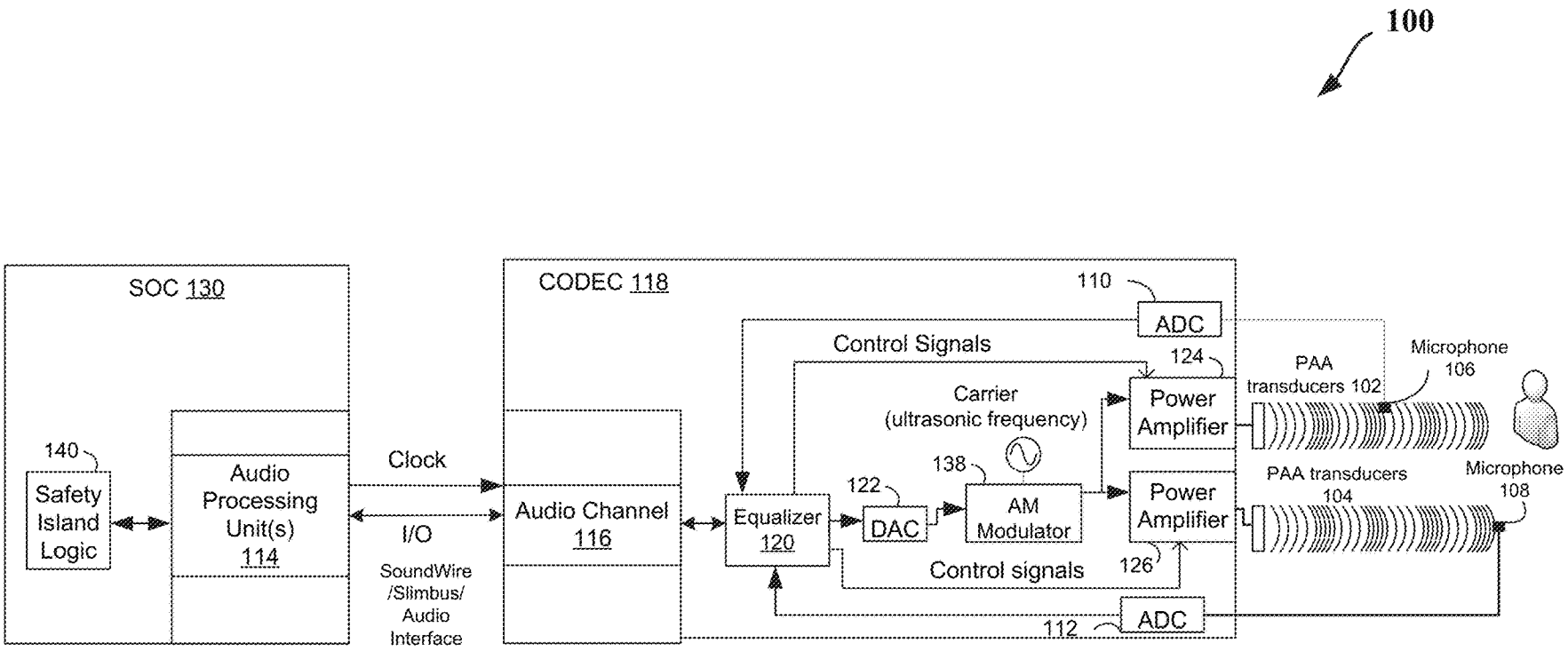
FIGS. 1 and 2 illustrate block diagrams of systems for functional safety of critical audio systems for autonomous and industrial applications, according to some embodiments.

FIG. 1 illustrates a block diagram of a system 100 for functional safety of critical audio systems for autonomous and industrial applications, according to an embodiment. Referring to FIG. 1, a functional safety audio framework is provided which: (1) uses PAA audio communication (e.g., via PAA transducers 102/104) for testing in-field audio alert messages (e.g., periodically or as needed); (2) senses transmitted audio alert messages through one or more acoustic microphones 106/108 and identifies audio test message mismatches (e.g., at audio processing unit/logic 114, where the audio signals are first converted to digital form by ADCs 110/112); (3) uses audio processing logic/unit(s) 114 to provide corrective action through an audio channel 116 to CODEC logic 118 by tuning the CODEC's critical parameters (like equalizer 120 gain, DAC (Digital-to-Analog Converter) logic 122 settings, Power Amplifier (PA) 124/126 gain and/or its performance parameters, etc.).

Such embodiments are envisioned to provide one or more of: unique and differentiating architecture solution; helping in enabling a functional safety audio test mechanism for functional safety audio sub-systems; and/or help with continuous monitoring of audio alert messages, while not disturbing end-users (or other vehicle occupants such as passengers) with periodic audio test patterns.

In an embodiment, PAA transducers 102/104 include parametric loudspeakers which generate unidirectional sound using ultrasound waves. In operation, the PAA transducers rely on the interaction of non-linear acoustics of sound waves in air, and an audio signal is generated in the air because of the self-demodulation effect. Moreover, during functional safety audio system testing (e.g., based on test patterns generated by functional safety island engine/logic 140), vehicle occupants will not be disturbed as the generated ultrasonic signals are highly directional and are only detectable by the microphone(s) 106/108. Later the audio test patterns detected by the microphones are converted into digital signals (e.g., by ADC logic 110/112) for further audio processing and communicated to SOC 130 through the audio communication channel 116.

In one or more embodiments, the audio channel 116 may provide a communication channel between the CODEC 118 and SOC 130 (and the audio processing unit(s) 114) via an I2S (Inter IC Sound) interface (which is a serial communication bus), SoundWire® interface (introduced in 2014 by the MIPI Alliance), Slimbus™ interface (where Slimbus stands for Serial low-power inter-chip media bus, which was developed by the MIPI Alliance, starting in 2007), or any other audio Input/Output (IO or I/O) interface. Whenever there is mismatch in the received test pattern (e.g., as detected by the audio processing unit(s) 114) with the transmitted pattern (e.g., due to ambient or other extraneous factors), the audio processing unit(s) apply feedforward correction to the CODEC 118. This correction code could, for example, change CODEC DAC configuration, equalization Configurations, or PA Gain related configurations. This continuous audio loop back system provides a secure audio system for functional safety applications.

Figure 2:
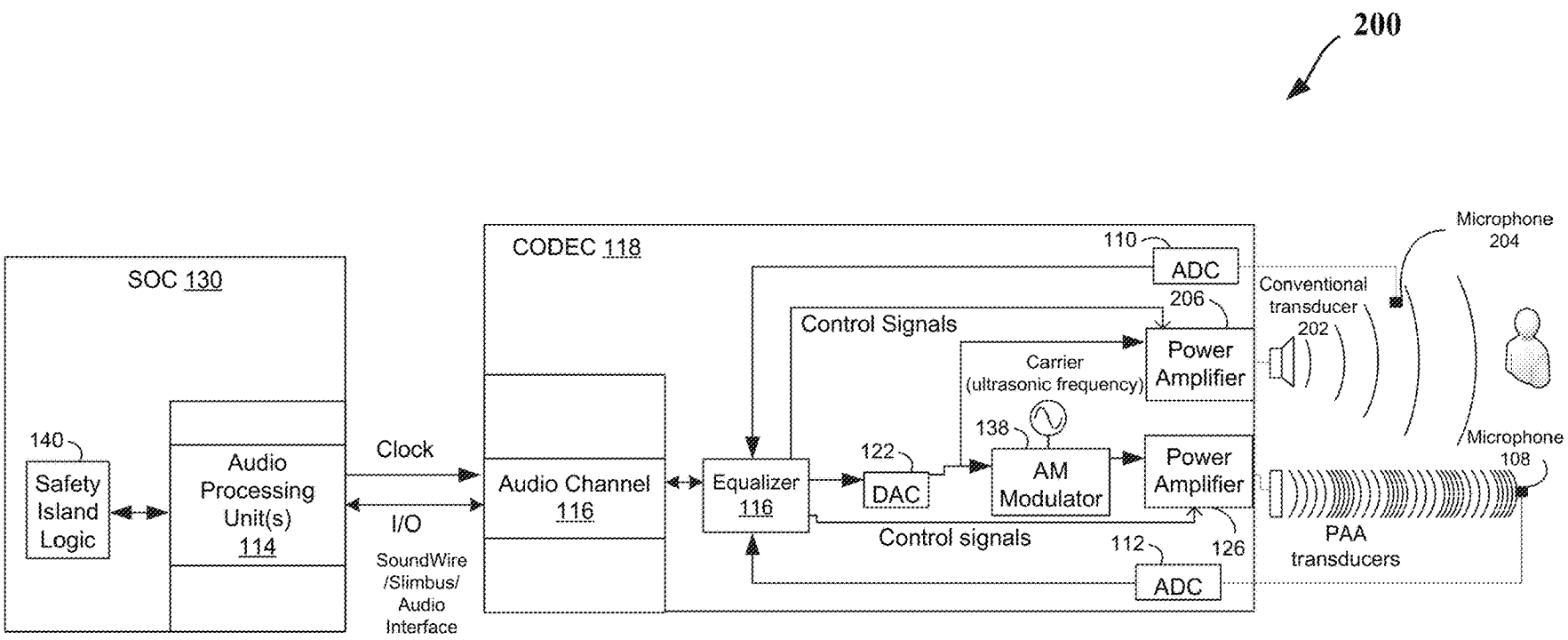

FIG. 2 illustrates a block diagram of a system 200 for functional safety of critical audio systems for autonomous and industrial applications, according to an embodiment. More particularly, system 200 illustrates an end-user receiving audio signals through a conventional transducer/speaker (or an omnidirectional transducer/speaker), while system 100 illustrates an end-user receiving audio signals through PAA transducers/speakers. Both solutions can achieve similar results. When both test and end-user transducers are PAAs (as in FIG. 1), system validation can be done by powering on the power amplifiers 124/126 (where each amplifier is coupled to receive ultrasonic waves generated by AM (Amplitude Modulation) modulator logic 138 per a carrier ultrasonic frequency). When the conventional speaker 202 is used in conjunction with microphone 204 (as in FIG. 2), test path and alert message are deviated after the signal is converted to analog by DAC logic 122 (one signal goes to the amplifier 126 via the AM modulator logic 138 and the other signal goes to the power amplifier 206 directly). Further, in both systems, both paths need to be functional for safety applications in an embodiment.

During test mode, the microphone and the corresponding power amplifier for the PAA transducers are switched-on, while disabling the power amplifier directed towards (and intended to be heard by) the end-user. When the audio alert message is intended for the end-user to hear, both microphone and consumer intended transducers can be switched-on to ensure the consumer has successfully received the alert message, while the feedback loop verifies the alert message is heard by the user.

In an embodiment, the test path (using the PAA transducers and corresponding microphone(s)) can be used for continuous monitoring and feedforward correction to avoid distortion of the signal that is being transmitted. In alert message mode, both consumer and microphone receive the signals and the transmitted message is verified against the received message. Alert message path can also be used for verification and fine-tuning for any signal distortions in one embodiment. As discussed, a "consumer" or an "end-user" generally refer to a vehicle occupant or operator/driver.

Figure 3:
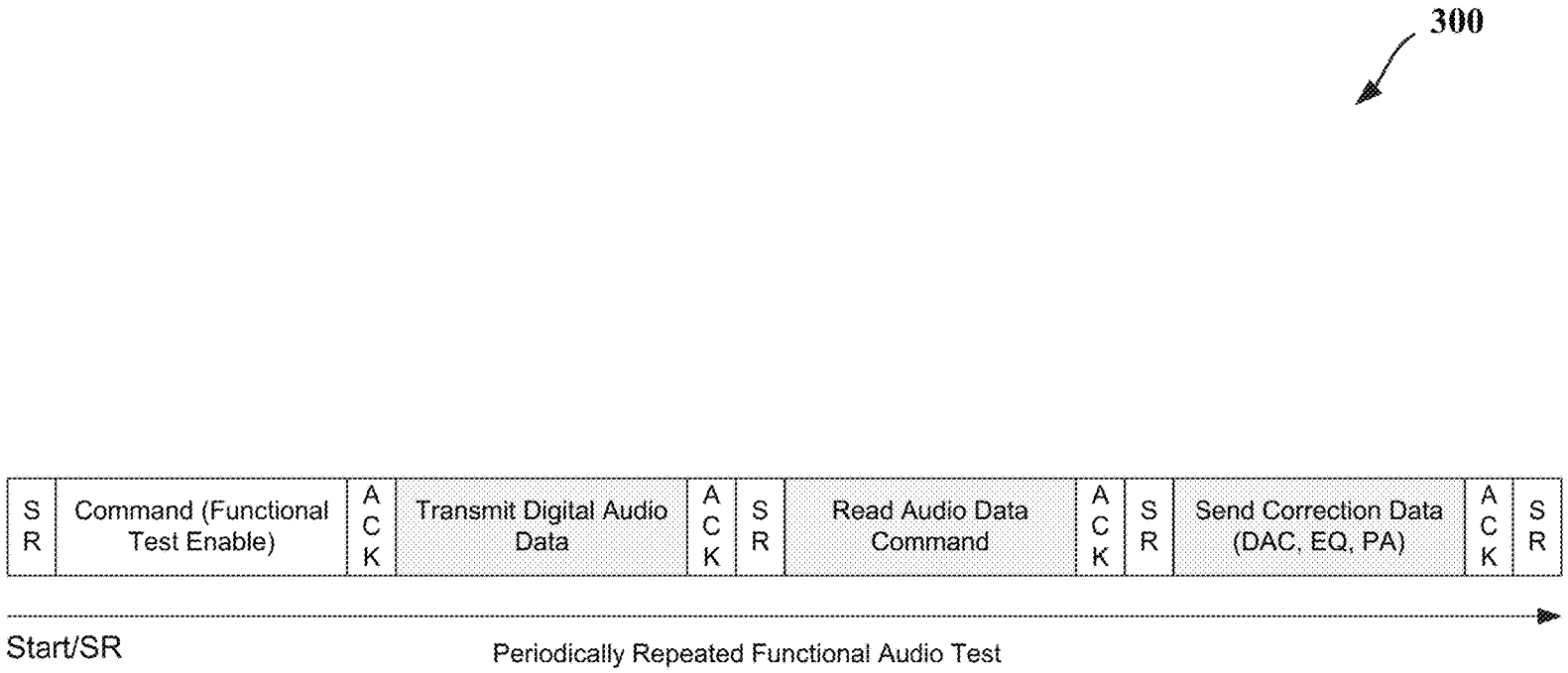
FIG. 3 illustrates a high level block diagram of a communication packet to be transmitted between audio processing unit(s) and CODEC logic, according to an embodiment.

FIG. 3 illustrates a high level block diagram of a communication packet 300 to be transmitted between audio processing unit(s) and CODEC logic, according to an embodiment. For example, the packet 300 may be transmitted between the audio processing unit(s) 114 and the CODEC logic 118 of FIGS. 1 and/or 2. Here "SR" represent Start or Repeated Start for bus turnaround time and "ACK" indicates an acknowledgement signal. Start refers as Start of packet. As shown, the communication packet 300 (which may be periodically repeated or transmitted as needed) in order includes one or more bits corresponding to: a start, a command (e.g., indicating a functional test enable mode), an ACK, digital audio data, an ACK, an SR, read audio data command, an ACK, an SR, send correction data, an ACK, and an SR.

Figure 4:
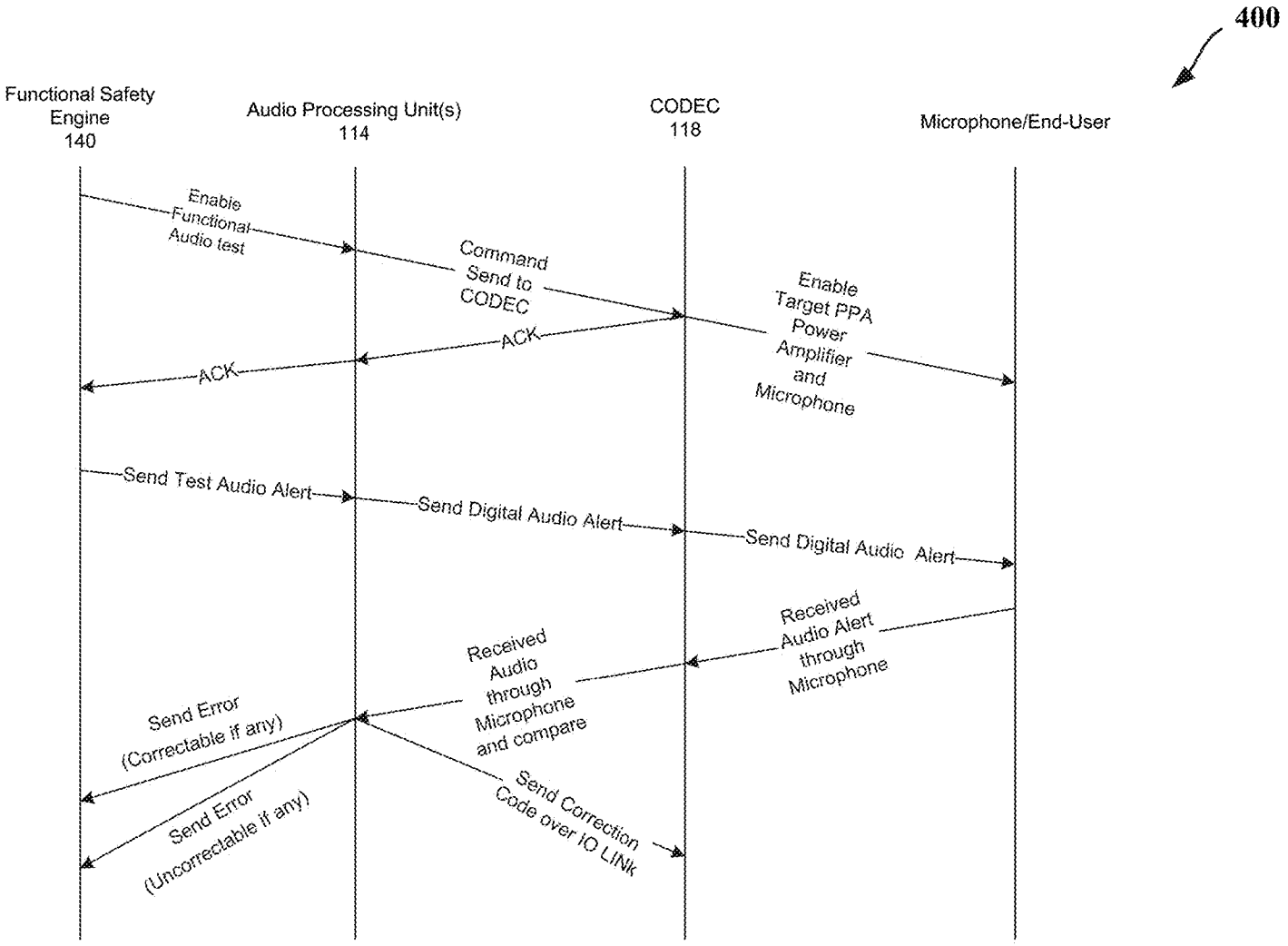
FIG. 4 illustrates a high level communication flow between audio processing unit(s) and CODEC logic, according to an embodiment.

FIG. 4 illustrates a high level communication flow 400 between audio processing unit(s) and CODEC logic, according to an embodiment. For example, the packet 300 may be transmitted between the audio processing unit(s) 114 and the CODEC logic 118 of FIGS. 1 and/or 2. Referring to FIG. 4, logic 140 initiates the flow 400 by transmitting an enable functional safety audio test signal. In response, logic 114 sends a command to the CODEC logic 118 (for which logic 114 receives an ACK signal and an ACK is also sent to the logic 140). In response to the command from logic 114, CODEC logic 118 sends a signal to enable target PPA power amplifier and corresponding microphone.

As shown in FIG. 4, logic 140 may also transmit a test audio alert to logic 114, in response to which logic 114 sends a digital audio alert in digital form that is forwarded to CODEC 118 and microphone/end-user). After receiving the audio alert, microphone send a signal back to logic 118 corresponding to the received audio alert through the microphone. CODEC 118 forwards the received audio for comparison operations to the logic 114. In response, audio processing unit(s) 114 may send a correction code over IO link to the CODEC 118 and/or one or more signals regarding the error (e.g., whether correctable or uncorrectable) to the logic 140.

In one embodiment, logic and/or various components discussed with reference to FIGS. 1-4 (including the audio processing unit(s) 114, SOC 130, logic 140, CODEC 118, conventional and PAA transducers, etc.) may be mounted or otherwise physically coupled to a vehicle. As discussed herein, a "vehicle" generally refers to any transportation device capable of being operated autonomously (with little or no human/driver intervention), such as an automobile, a truck, a motorcycle, an airplane, a helicopter, a vessel/ship, a train, a drone, etc. whether or not the vehicle is a passenger or commercial vehicle, and regardless of the power source type (such as one or more of: fossil fuel(s), solar energy, electric energy, chemical energy, nuclear energy, etc.) and regardless of the physical state of the power source (e.g., solid, liquid, gaseous, etc.) used to move the vehicle.

Figure 5:
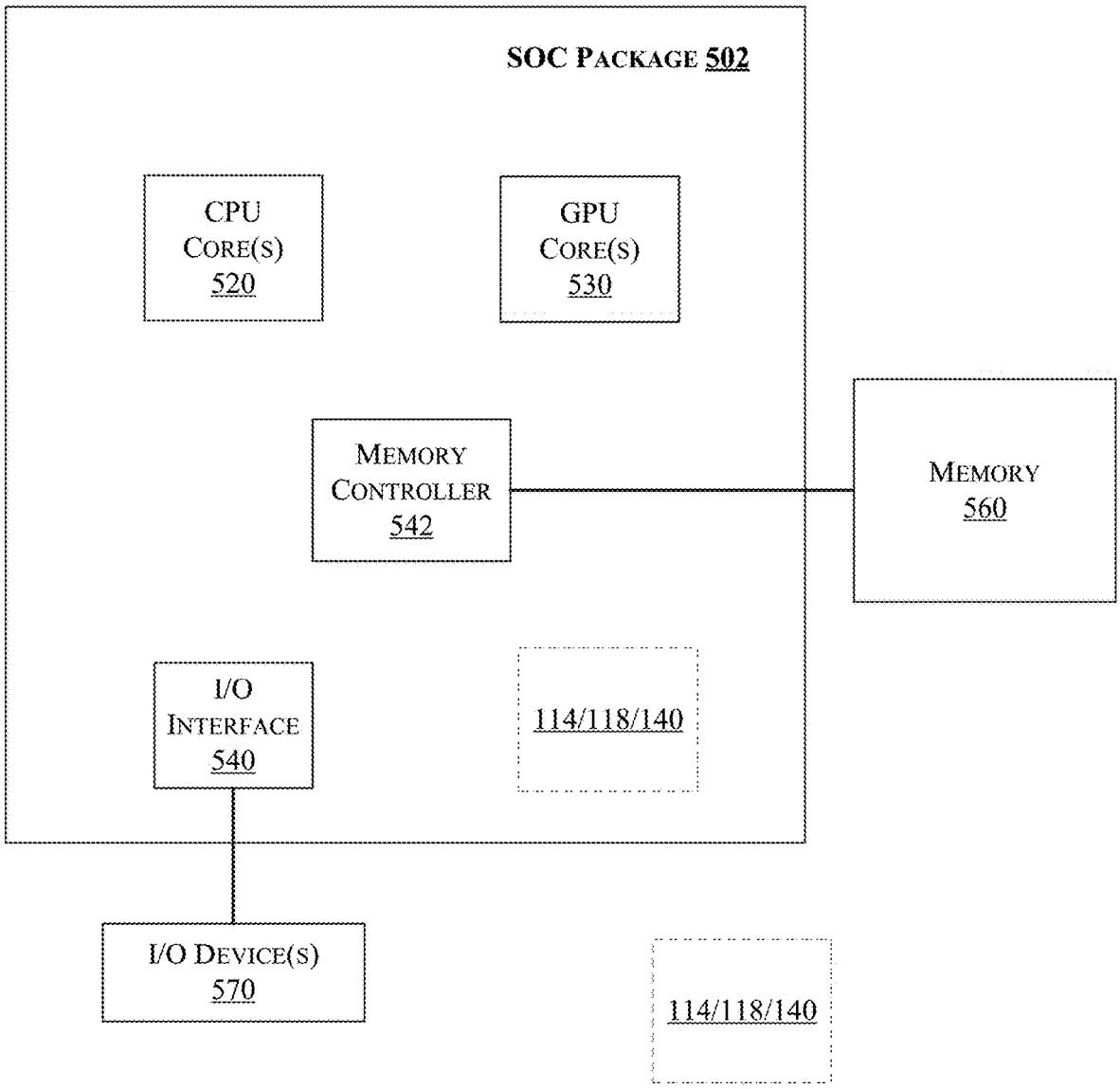
FIGS. 5 and 6 illustrates block diagrams of embodiments of computing systems, which may be utilized in various embodiments discussed herein.

FIG. 5 illustrates a block diagram of an SOC package in accordance with an embodiment. As illustrated in FIG. 5, SOC 502 includes one or more Central Processing Unit (CPU) cores 520, one or more Graphics Processor Unit (GPU) cores 530, an Input/Output (I/O) interface 540, and a memory controller 542. Various components of the SOC package 502 may be coupled to an interconnect or bus such as discussed herein with reference to the other figures. Also, the SOC package 502 may include more or less components, such as those discussed herein with reference to the other figures. Further, each component of the SOC package 520 may include one or more other components, e.g., as discussed with reference to the other figures herein. In one embodiment, SOC package 502 (and its components) is provided on one or more Integrated Circuit (IC) die, e.g., which are packaged into a single semiconductor device.

As illustrated in FIG. 5, SOC package 502 is coupled to a memory 560 via the memory controller 542. In an embodiment, the memory 560 (or a portion of it) can be integrated on the SOC package 502.

The I/O interface 540 may be coupled to one or more I/O devices 570, e.g., via an interconnect and/or bus such as discussed herein with reference to other figures. I/O device(s) 570 may include one or more of a keyboard, a mouse, a touchpad, a display, an image/video capture device (such as a camera or camcorder/video recorder), a touch screen, a speaker, or the like.

Figure 6:
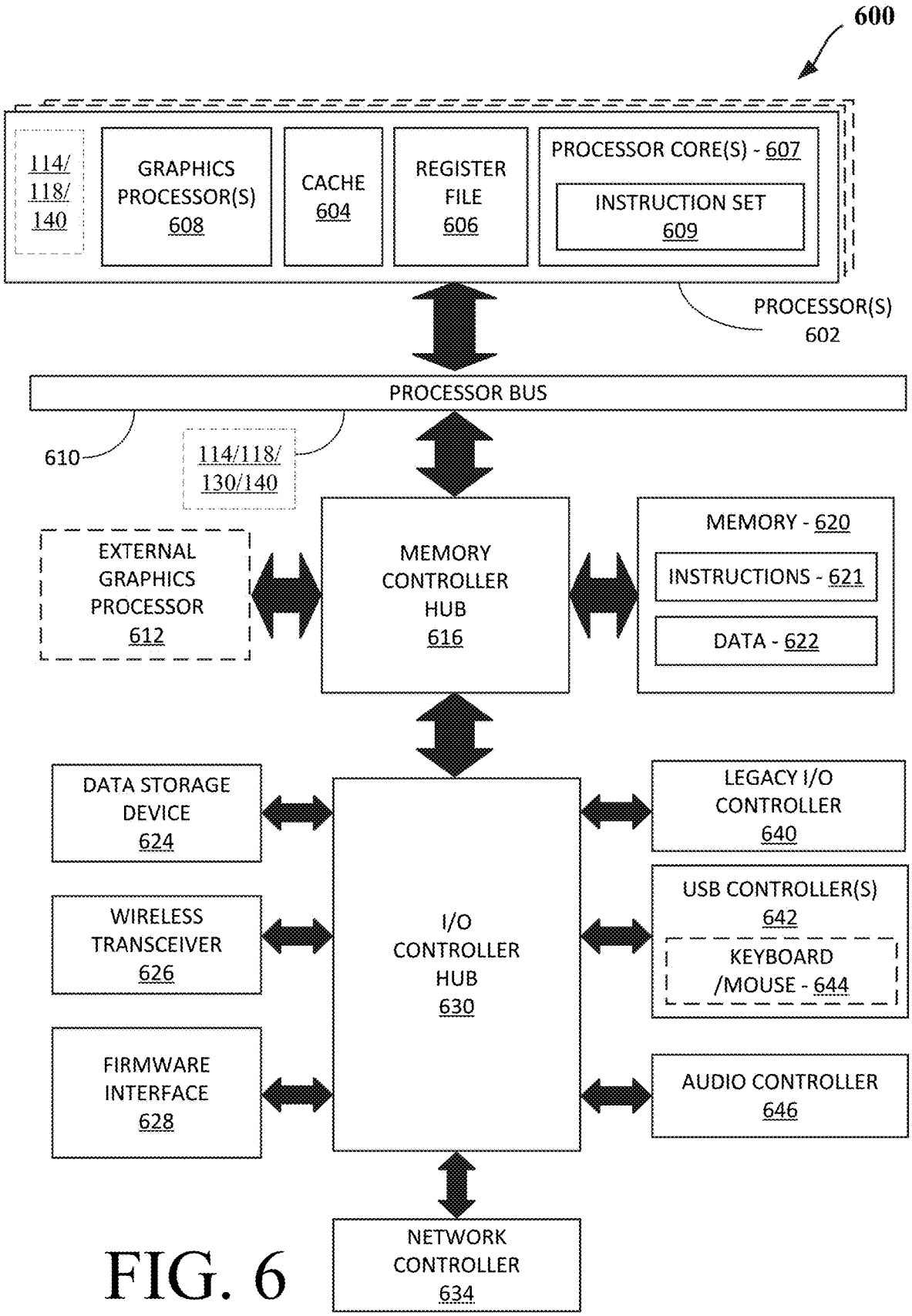

FIG. 6 is a block diagram of a processing system 600, according to an embodiment. In various embodiments the system 600 includes one or more processors 602 and one or more graphics processors 608, and may be a single processor desktop system, a multiprocessor workstation system, or a server system having a large number of processors 602 or processor cores 607. In on embodiment, the system 600 is a processing platform incorporated within a system-on-a-chip (SoC or SOC) integrated circuit for use in mobile, handheld, or embedded devices.

An embodiment of system 600 can include, or be incorporated within a server-based gaming platform, a game console, including a game and media console, a mobile gaming console, a handheld game console, or an online game console. In some embodiments system 600 is a mobile phone, smart phone, tablet computing device or mobile Internet device. Data processing system 600 can also include, couple with, or be integrated within a wearable device, such as a smart watch wearable device, smart eyewear device, augmented reality device, or virtual reality device. In some embodiments, data processing system 600 is a television or set top box device having one or more processors 602 and a graphical interface generated by one or more graphics processors 608.

In some embodiments, the one or more processors 602 each include one or more processor cores 607 to process instructions which, when executed, perform operations for system and user software. In some embodiments, each of the one or more processor cores 607 is configured to process a specific instruction set 609. In some embodiments, instruction set 609 may facilitate Complex Instruction Set Computing (CISC), Reduced Instruction Set Computing (RISC), or computing via a Very Long Instruction Word (VLIW). Multiple processor cores 607 may each process a different instruction set 609, which may include instructions to facilitate the emulation of other instruction sets. Processor core 607 may also include other processing devices, such a Digital Signal Processor (DSP).

In some embodiments, the processor 602 includes cache memory 604. Depending on the architecture, the processor 602 can have a single internal cache or multiple levels of internal cache. In some embodiments, the cache memory is shared among various components of the processor 602. In some embodiments, the processor 602 also uses an external cache (e.g., a Level-3 (L3) cache or Last Level Cache (LLC)) (not shown), which may be shared among processor cores 607 using known cache coherency techniques. A register file 606 is additionally included in processor 602 which may include different types of registers for storing different types of data (e.g., integer registers, floating point registers, status registers, and an instruction pointer register). Some registers may be general-purpose registers, while other registers may be specific to the design of the processor 602.

In some embodiments, processor 602 is coupled to a processor bus 610 to transmit communication signals such as address, data, or control signals between processor 602 and other components in system 600. In one embodiment the system 600 uses an exemplary 'hub' system architecture, including a memory controller hub 616 and an Input Output (I/O) controller hub 630. A memory controller hub 616 facilitates communication between a memory device and other components of system 600, while an I/O Controller Hub (ICH) 630 provides connections to I/O devices via a local I/O bus. In one embodiment, the logic of the memory controller hub 616 is integrated within the processor.

Memory device 620 can be a dynamic random access memory (DRAM) device, a static random access memory (SRAM) device, flash memory device, phase-change memory device, or some other memory device having suitable performance to serve as process memory. In one embodiment the memory device 620 can operate as system memory for the system 600, to store data 622 and instructions 621 for use when the one or more processors 602 executes an application or process. Memory controller hub 616 also couples with an optional external graphics processor 612, which may communicate with the one or more graphics processors 608 in processors 602 to perform graphics and media operations.

In some embodiments, ICH 630 enables peripherals to connect to memory device 620 and processor 602 via a high-speed I/O bus. The I/O peripherals include, but are not limited to, an audio controller 646, a firmware interface 628, a wireless transceiver 626 (e.g., Wi-Fi, Bluetooth), a data storage device 624 (e.g., hard disk drive, flash memory, etc.), and a legacy I/O controller 640 for coupling legacy (e.g., Personal System 2 (PS/2)) devices to the system. One or more Universal Serial Bus (USB) controllers 642 connect input devices, such as keyboard and mouse 644 combinations. A network controller 634 may also couple to ICH 630. In some embodiments, a high-performance network controller (not shown) couples to processor bus 610. It will be appreciated that the system 600 shown is exemplary and not limiting, as other types of data processing systems that are differently configured may also be used. For example, the I/O controller hub 630 may be integrated within the one or more processor 602, or the memory controller hub 616 and I/O controller hub 630 may be integrated into a discreet external graphics processor, such as the external graphics processor 612.

Figure 7:
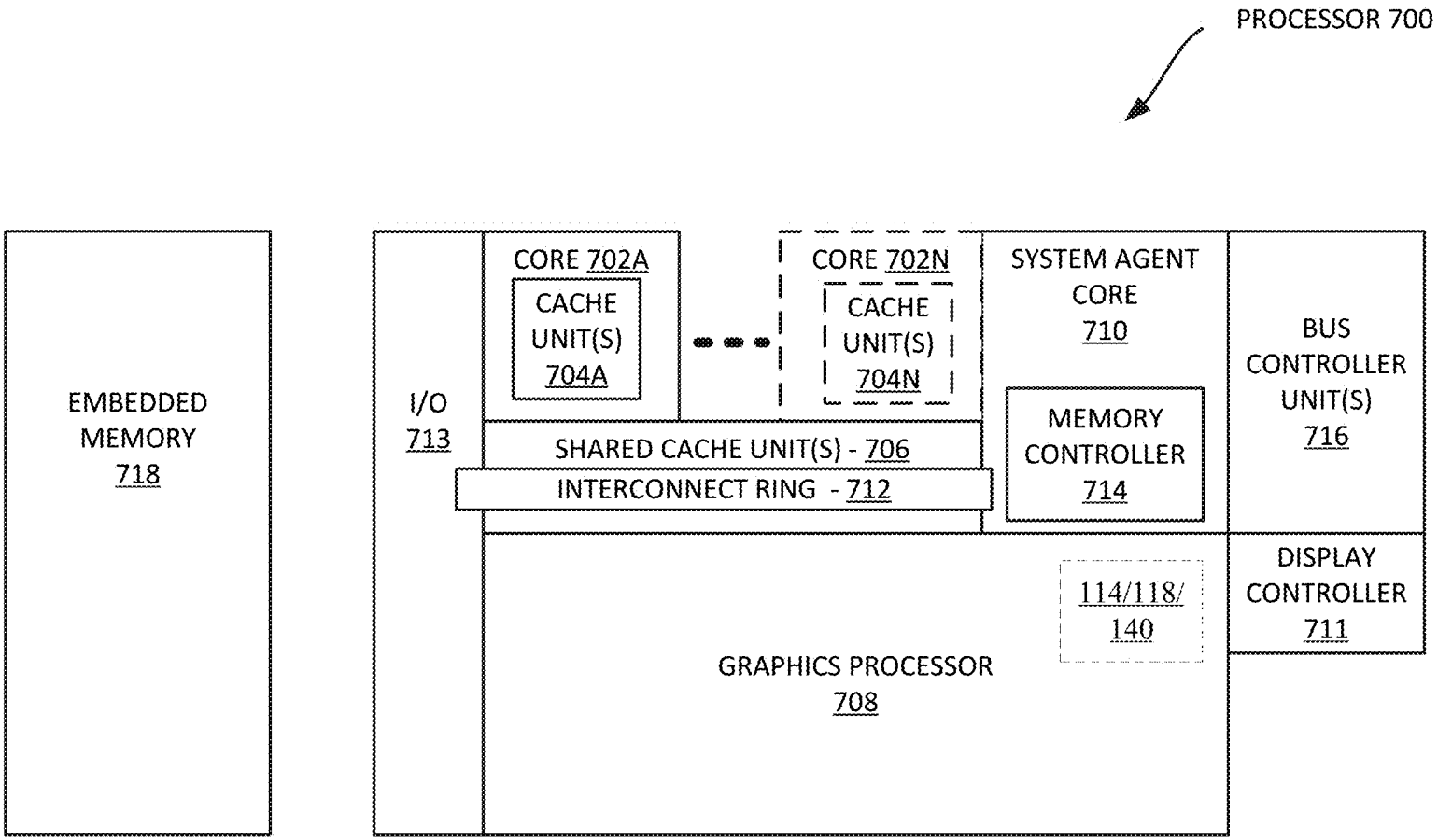
FIGS. 7 and 8 illustrate various components of processors in accordance with some embodiments.

FIG. 7 is a block diagram of an embodiment of a processor 700 having one or more processor cores 702A to 702N, an integrated memory controller 714, and an integrated graphics processor 708. Those elements of FIG. 7 having the same reference numbers (or names) as the elements of any other figure herein can operate or function in any manner similar to that described elsewhere herein, but are not limited to such. Processor 700 can include additional cores up to and including additional core 702N represented by the dashed lined boxes. Each of processor cores 702A to 702N includes one or more internal cache units 704A to 704N. In some embodiments each processor core also has access to one or more shared cached units 706.

The internal cache units 704A to 704N and shared cache units 706 represent a cache memory hierarchy within the processor 700. The cache memory hierarchy may include at least one level of instruction and data cache within each processor core and one or more levels of shared mid-level cache, such as a Level 2 (L2), Level 3 (L3), Level 4 (L4), or other levels of cache, where the highest level of cache before external memory is classified as the LLC. In some embodiments, cache coherency logic maintains coherency between the various cache units 706 and 704A to 704N.

In some embodiments, processor 700 may also include a set of one or more bus controller units 716 and a system agent core 710. The one or more bus controller units 716 manage a set of peripheral buses, such as one or more Peripheral Component Interconnect buses (e.g., PCI, PCI Express). System agent core 710 provides management functionality for the various processor components. In some embodiments, system agent core 710 includes one or more integrated memory controllers 714 to manage access to various external memory devices (not shown).

In some embodiments, one or more of the processor cores 702A to 702N include support for simultaneous multi-threading. In such embodiment, the system agent core 710 includes components for coordinating and operating cores 702A to 702N during multi-threaded processing. System agent core 710 may additionally include a power control unit (PCU), which includes logic and components to regulate the power state of processor cores 702A to 702N and graphics processor 708.

In some embodiments, processor 700 additionally includes graphics processor 708 to execute graphics processing operations. In some embodiments, the graphics processor 708 couples with the set of shared cache units 706, and the system agent core 710, including the one or more integrated memory controllers 714. In some embodiments, a display controller 711 is coupled with the graphics processor 708 to drive graphics processor output to one or more coupled displays. In some embodiments, display controller 711 may be a separate module coupled with the graphics processor via at least one interconnect, or may be integrated within the graphics processor 708 or system agent core 710.

In some embodiments, a ring based interconnect unit 712 is used to couple the internal components of the processor 700. However, an alternative interconnect unit may be used, such as a point-to-point interconnect, a switched interconnect, or other techniques, including techniques well known in the art. In some embodiments, graphics processor 708 couples with the ring interconnect 712 via an I/O link 713.

The exemplary I/O link 713 represents at least one of multiple varieties of I/O interconnects, including an on package I/O interconnect which facilitates communication between various processor components and a high-performance embedded memory module 718, such as an eDRAM (or embedded DRAM) module. In some embodiments, each of the processor cores 702 to 702N and graphics processor 708 use embedded memory modules 718 as a shared Last Level Cache.

In some embodiments, processor cores 702A to 702N are homogenous cores executing the same instruction set architecture. In another embodiment, processor cores 702A to 702N are heterogeneous in terms of instruction set architecture (ISA), where one or more of processor cores 702A to 702N execute a first instruction set, while at least one of the other cores executes a subset of the first instruction set or a different instruction set. In one embodiment processor cores 702A to 702N are heterogeneous in terms of micro-architecture, where one or more cores having a relatively higher power consumption couple with one or more power cores having a lower power consumption. Additionally, processor 700 can be implemented on one or more chips or as an SoC integrated circuit having the illustrated components, in addition to other components.

Figure 8:
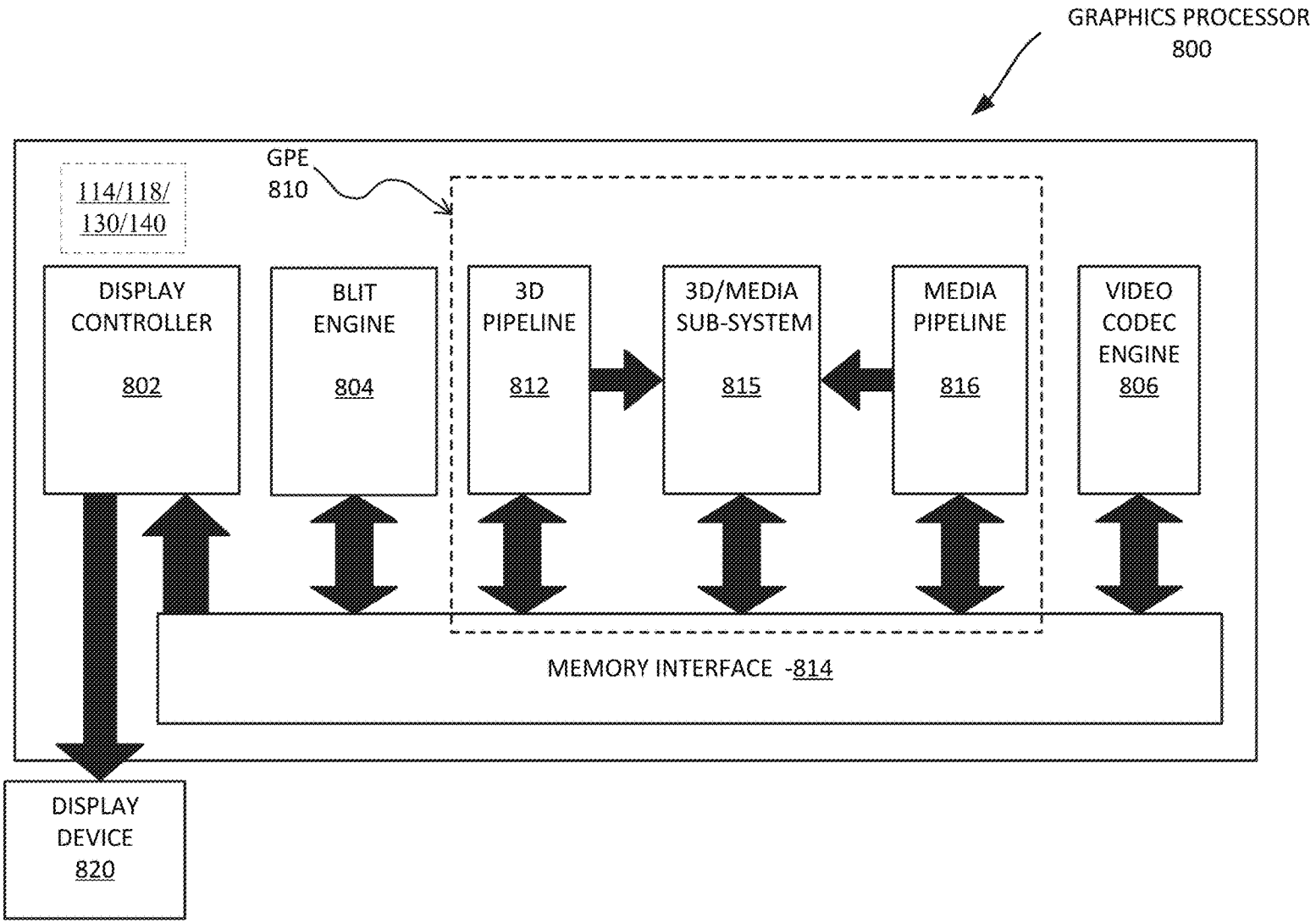

FIG. 8 is a block diagram of a graphics processor 800, which may be a discrete graphics processing unit, or may be a graphics processor integrated with a plurality of processing cores. In some embodiments, the graphics processor communicates via a memory mapped I/O interface to registers on the graphics processor and with commands placed into the processor memory. In some embodiments, graphics processor 800 includes a memory interface 814 to access memory. Memory interface 814 can be an interface to local memory, one or more internal caches, one or more shared external caches, and/or to system memory.

In some embodiments, graphics processor 800 also includes a display controller 802 to drive display output data to a display device 820. Display controller 802 includes hardware for one or more overlay planes for the display and composition of multiple layers of video or user interface elements. In some embodiments, graphics processor 800 includes a video codec engine 806 to encode, decode, or transcode media to, from, or between one or more media encoding formats, including, but not limited to Moving Picture Experts Group (MPEG) formats such as MPEG-2, Advanced Video Coding (AVC) formats such as H.264/MPEG-4 AVC, as well as the Society of Motion Picture & Television Engineers (SMPTE) 421M/VC-1, and Joint Photographic Experts Group (JPEG) formats such as JPEG, and Motion JPEG (MJPEG) formats.

In some embodiments, graphics processor 800 includes a block image transfer (BLIT) engine 804 to perform two-dimensional (2D) rasterizer operations including, for example, bit-boundary block transfers. However, in one embodiment, 8D graphics operations are performed using one or more components of graphics processing engine (GPE) 810. In some embodiments, graphics processing engine 810 is a compute engine for performing graphics operations, including three-dimensional (3D) graphics operations and media operations.

In some embodiments, GPE 810 includes a 3D pipeline 812 for performing 3D operations, such as rendering three-dimensional images and scenes using processing functions that act upon 3D primitive shapes (e.g., rectangle, triangle, etc.). The 3D pipeline 812 includes programmable and fixed function elements that perform various tasks within the element and/or spawn execution threads to a 3D/Media sub-system 815. While 3D pipeline 812 can be used to perform media operations, an embodiment of GPE 810 also includes a media pipeline 816 that is specifically used to perform media operations, such as video post-processing and image enhancement.

In some embodiments, media pipeline 816 includes fixed function or programmable logic units to perform one or more specialized media operations, such as video decode acceleration, video de-interlacing, and video encode acceleration in place of, or on behalf of video codec engine 806. In some embodiments, media pipeline 816 additionally includes a thread spawning unit to spawn threads for execution on 3D/Media sub-system 815. The spawned threads perform computations for the media operations on one or more graphics execution units included in 3D/Media subsystem 815.

In some embodiments, 3D/Media subsystem 815 includes logic for executing threads spawned by 3D pipeline 812 and media pipeline 816. In one embodiment, the pipelines send thread execution requests to 3D/Media subsystem 815, which includes thread dispatch logic for arbitrating and dispatching the various requests to available thread execution resources. The execution resources include an array of graphics execution units to process the 3D and media threads. In some embodiments, 3D/Media subsystem 815 includes one or more internal caches for thread instructions and data. In some embodiments, the subsystem also includes shared memory, including registers and addressable memory, to share data between threads and to store output data.

The following examples pertain to further embodiments. Example 1 includes an apparatus comprising: safety island logic circuitry to transmit an enable signal to cause initiation of a functional safety test for an audio component in a vehicle; and audio processing logic circuitry to receive the enable signal and cause activation of power amplifier logic circuitry, in response to the enable signal, to drive the audio component in accordance with an audio alert test signal, wherein the audio component comprises a Parametric Acoustic Array (PAA) transducer. Example 2 includes the apparatus of example 1, wherein the PAA transducer is to generate ultrasonic signals, wherein the ultrasonic signals are undetectable by an occupant of the vehicle. Example 3 includes the apparatus of example 1, wherein the safety island logic circuitry is to generate the audio alert test signal. Example 4 includes the apparatus of example 1, wherein the enable signal is to cause activation of the power amplifier logic circuitry and the audio component. Example 5 includes the apparatus of example 1, comprising one or more microphones to detect an audio signal to be generated by the audio component in response to the audio alert test signal. Example 6 includes the apparatus of example 1, wherein a coder-decoder logic is to comprise the power amplifier logic circuitry, an analog-to-digital converter logic, coupled to receive an audio signal from a microphone, and a digital-to-analog converter logic to transmit a signal to the power amplifier logic circuitry to cause the power amplifier logic circuitry to drive the audio component. Example 7 includes the apparatus of example 6, wherein the audio processing logic circuitry is to transmit correction command to the coder-decoder logic in response to a determination that an error exists based on comparison of an audio signal to be generated by the audio component in response to the audio alert test signal and the audio alert test signal. Example 8 includes the apparatus of example 6, comprising an input/output interface coupled between the coder-decoder logic and the audio processing logic circuitry. Example 9 includes the apparatus of example 8, wherein the input/output interface comprises one or more of: an I2S (Inter IC Sound) interface, a SoundWire® interface, or a Slimbus™ interface. Example 10 includes the apparatus of example 1, wherein the audio processing logic circuitry is to determine whether an error exists based on comparison of an audio signal to be generated by the audio component in response to the audio alert test signal and the audio alert test signal. Example 11 includes the apparatus of example 1, wherein the audio processing logic circuitry is to transmit an error signal to the safety island logic circuitry in response to a determination that an error exists based on comparison of an audio signal to be generated by the audio component in response to the 7audio alert test signal and the audio alert test signal. Example 12 includes the apparatus of example 1, wherein the audio component further comprises an omnidirectional transducer. Example 13 includes the apparatus of example 1, wherein a System On Chip (SOC) device comprises the safety island logic circuitry and the audio processing logic circuitry, wherein the audio processing logic circuitry is coupled to the power amplifier logic circuitry via an input/output bus or a system bus. Example 14 includes the apparatus of example 1, wherein an Internet of Things (IoT) device comprise one or more of: the safety island logic circuitry, the power amplifier logic circuitry, the audio component, the audio processing logic circuitry, and memory. Example 15 includes the apparatus of example 1, wherein a single integrated device comprises one or more of: a processor, the safety island logic circuitry, the audio processing logic circuitry, and memory. Example 16 includes the apparatus of example 1, wherein the vehicle comprises one or more of: an automobile, a truck, a motorcycle, an airplane, a helicopter, a vessel or ship, a train, or a drone.

Example 17 includes one or more computer-readable medium comprising one or more instructions that when executed on at least one processor configure the at least one processor to perform one or more operations to cause: safety island logic to transmit an enable signal to cause initiation of a functional safety test for an audio component in a vehicle; and audio processing logic to receive the enable signal and cause activation of power amplifier logic, in response to the enable signal, to drive the audio component in accordance with an audio alert test signal, wherein the audio component comprises a Parametric Acoustic Array (PAA) transducer. Example 18 includes the one or more computer-readable medium of example 17, further comprising one or more instructions that when executed on the at least one processor configure the at least one processor to perform one or more operations to the PAA transducer to generate ultrasonic signals, wherein the ultrasonic signals are undetectable by an occupant of the vehicle. Example 19 includes the one or more computer-readable medium of example 17, further comprising one or more instructions that when executed on the at least one processor configure the at least one processor to perform one or more operations to cause the safety island logic to generate the audio alert test signal. Example 20 includes the one or more computer-readable medium of example 17, further comprising one or more instructions that when executed on the at least one processor configure the at least one processor to perform one or more operations to cause activation of the power amplifier logic circuitry and the audio component in response to the enable signal.

Example 21 includes an apparatus comprising means to perform a method as set forth in any preceding example. Example 22 includes machine-readable storage including machine-readable instructions, when executed, to implement a method or realize an apparatus as set forth in any preceding example.

In various embodiments, the operations discussed herein, e.g., with reference to FIG. 1 et seq., may be implemented as hardware (e.g., logic circuitry or more generally circuitry or circuit), software, firmware, or combinations thereof, which may be provided as a computer program product, e.g., including a tangible (e.g., non-transitory) machine-readable or computer-readable medium having stored thereon instructions (or software procedures) used to program a computer to perform a process discussed herein. The machine-readable medium may include a storage device such as those discussed with respect to FIG. 1 et seq.

Additionally, such computer-readable media may be downloaded as a computer program product, wherein the program may be transferred from a remote computer (e.g., a server) to a requesting computer (e.g., a client) by way of data signals provided in a carrier wave or other propagation medium via a communication link (e.g., a bus, a modem, or a network connection).

Reference in the specification to "one embodiment" or "an embodiment" means that a particular feature, structure, and/or characteristic described in connection with the embodiment may be included in at least an implementation. The appearances of the phrase "in one embodiment" in various places in the specification may or may not be all referring to the same embodiment.

Also, in the description and claims, the terms "coupled" and "connected," along with their derivatives, may be used. In some embodiments, "connected" may be used to indicate that two or more elements are in direct physical or electrical contact with each other. "Coupled" may mean that two or more elements are in direct physical or electrical contact. However, "coupled" may also mean that two or more elements may not be in direct contact with each other, but may still cooperate or interact with each other.

Thus, although embodiments have been described in language specific to structural features and/or methodological acts, it is to be understood that claimed subject matter may not be limited to the specific features or acts described. Rather, the specific features and acts are disclosed as sample forms of implementing the claimed subject matter.

The invention claimed is:

1. An apparatus comprising:

safety island logic circuitry to transmit an enable signal to cause initiation of a functional safety test for a Parametric Acoustic Array (PAA) transducer in a vehicle; and audio processing logic circuitry to receive the enable signal and cause activation of power amplifier logic circuitry, in response to the enable signal, to drive the PAA transducer in accordance with an audio alert test signal, wherein an Internet of Things (IoT) device comprises: the safety island logic circuitry, the power amplifier logic circuitry, the PAA transducer, the audio processing logic circuitry, and memory.

2. The apparatus of claim 1, wherein the PAA transducer is to generate ultrasonic signals, wherein the ultrasonic signals are undetectable by an occupant of the vehicle.

3. The apparatus of claim 1, wherein the safety island logic circuitry is to generate the audio alert test signal.

4. The apparatus of claim 1, wherein the enable signal is to cause activation of the power amplifier logic circuitry and the PAA transducer.

5. The apparatus of claim 1, comprising one or more microphones to detect an audio signal to be generated by the PAA transducer in response to the audio alert test signal.

6. The apparatus of claim 1, wherein a coder-decoder logic is to comprise the power amplifier logic circuitry, an analog-to-digital converter logic, coupled to receive an audio signal from a microphone, and a digital-to-analog converter logic to transmit a signal to the power amplifier logic circuitry to cause the power amplifier logic circuitry to drive the PAA transducer.

7. The apparatus of claim 6, wherein the audio processing logic circuitry is to transmit correction command to the coder-decoder logic in response to a determination that an error exists based on comparison of an audio signal to be generated by the PAA transducer in response to the audio alert test signal and the audio alert test signal.

8. The apparatus of claim 6, comprising an input/output interface coupled between the coder-decoder logic and the audio processing logic circuitry.

9. The apparatus of claim 8, wherein the input/output interface comprises one or more of: an I2S (Inter IC Sound) interface, a SoundWire® interface, or a Slimbus™ interface.

10. The apparatus of claim 1, wherein the audio processing logic circuitry is to determine whether an error exists based on comparison of an audio signal to be generated by the PAA transducer in response to the audio alert test signal and the audio alert test signal.

11. The apparatus of claim 1, wherein the audio processing logic circuitry is to transmit an error signal to the safety island logic circuitry in response to a determination that an error exists based on comparison of an audio signal to be generated by the PAA transducer in response to the audio alert test signal and the audio alert test signal.

12. The apparatus of claim 1, wherein the PAA transducer further comprises an omnidirectional transducer.

13. The apparatus of claim 1, wherein a System On Chip (SOC) device comprises the safety island logic circuitry and the audio processing logic circuitry, wherein the audio processing logic circuitry is coupled to the power amplifier logic circuitry via an input/output bus or a system bus.

14. The apparatus of claim 1, wherein a single integrated device comprises one or more of: a processor, the safety island logic circuitry, the audio processing logic circuitry, and memory.

15. The apparatus of claim 1, wherein the vehicle comprises one or more of: an automobile, a truck, a motorcycle, an airplane, a helicopter, a vessel or ship, a train, or a drone.

16. One or more non-transitory computer-readable medium comprising one or more instructions that when executed on at least one processor configure the at least one processor to perform one or more operations to cause:

safety island logic to transmit an enable signal to cause initiation of a functional safety test for a Parametric Acoustic Array (PAA) transducer in a vehicle; and audio processing logic to receive the enable signal and cause activation of power amplifier logic, in response to the enable signal, to drive the PAA transducer in accordance with an audio alert test signal, wherein an Internet of Things (IoT) device comprises: the safety island logic circuitry, the power amplifier logic circuitry, the PAA transducer, the audio processing logic circuitry, and memory.

17. The one or more non-transitory computer-readable medium of claim 16, further comprising one or more instructions that when executed on the at least one processor configure the at least one processor to perform one or more operations to the PAA transducer to generate ultrasonic signals, wherein the ultrasonic signals are undetectable by an occupant of the vehicle.

18. The one or more non-transitory computer-readable medium of claim 16, further comprising one or more instructions that when executed on the at least one processor configure the at least one processor to perform one or more operations to cause the safety island logic to generate the audio alert test signal.

19. The one or more non-transitory computer-readable medium of claim 16, further comprising one or more instructions that when executed on the at least one processor configure the at least one processor to perform one or more operations to cause activation of the power amplifier logic circuitry and the PAA transducer in response to the enable signal.

* * * * *